US008193437B2

(12) United States Patent
Mizuhiki

(10) Patent No.: US 8,193,437 B2
(45) Date of Patent: Jun. 5, 2012

(54) ELECTRONIC MUSIC APPARATUS AND TONE CONTROL METHOD

(75) Inventor: Takashi Mizuhiki, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 13/051,604

(22) Filed: Mar. 18, 2011

(65) Prior Publication Data

US 2011/0162513 A1 Jul. 7, 2011

Related U.S. Application Data

(62) Division of application No. 12/483,914, filed on Jun. 12, 2009, now Pat. No. 7,960,639.

(30) Foreign Application Priority Data

Jun. 16, 2008 (JP) ..... 2008-157276
Jun. 16, 2008 (JP) ..... 2008-157277

(51) Int. Cl.
*G10H 1/00* (2006.01)

(52) U.S. Cl. ..... 84/622; 84/659; 84/692

(58) Field of Classification Search ..... 84/600–602, 84/622, 659, 692
See application file for complete search history.

(56) References Cited

U.S. PATENT DOCUMENTS 4,716,804 A 1/1988 Chadabe
5,027,689 A * 7/1991 Fujimori ..... 84/622
5,113,744 A * 5/1992 Tanaka et al. ..... 84/634
5,153,829 A * 10/1992 Furuya et al. ..... 84/622
5,159,140 A * 10/1992 Kimpara et al. ..... 84/600
5,204,969 A * 4/1993 Capps et al. ..... 704/278
5,212,733 A * 5/1993 DeVitt et al. ..... 381/119
5,252,776 A 10/1993 Mutoh
5,276,272 A 1/1994 Masuda
5,288,938 A 2/1994 Wheaton
5,336,844 A 8/1994 Yamauchi et al.
5,391,827 A 2/1995 Koyama
5,488,196 A * 1/1996 Zimmerman et al. ..... 84/612
5,512,707 A 4/1996 Ohshima
5,559,301 A 9/1996 Bryan, Jr. et al.
5,684,259 A 11/1997 Horii (Continued)

OTHER PUBLICATIONS

Yamaha Corporation, MOTIF XS6/XS7/XS8, Music Production Synthesizer, Owner's Manual, 2007, available on the internet http://www.2.yamaha.co.jp/manual/pdf/emi/japan/synth/motifxsja-o_mc0.pdf. Cited in spec.

(Continued)

*Primary Examiner* — David S. Warren
(74) *Attorney, Agent, or Firm* — Rossi, Kimms & McDowell LLP

(57) ABSTRACT

First display object associated with a control operating member and a second display object associated with a tone color effect parameter are displayed, and variation of a displayed position of the first display object is controlled in accordance with operation of the control operating member. Control value of the tone color effect parameter is determined in response to variation in relationship between the first and second display objects, and tone control is performed on the basis of the determined control value. Further, the variation of the displayed position of the first display object is controlled so as to move on and along a set path, so that displayable positions of the first display object is limited to the set path. Control value of the tone color effect parameter is determined on the basis of relationship between displayed position of the first and second display objects to perform tone control.

10 Claims, 7 Drawing Sheets

U.S. PATENT DOCUMENTS 5,689,078 A * 11/1997 McClard ..... 84/600
5,812,688 A * 9/1998 Gibson ..... 381/119
5,952,599 A 9/1999 Dolby et al.
6,011,212 A 1/2000 Rigopulos et al.
6,021,204 A * 2/2000 Eastty ..... 381/12
6,081,266 A * 6/2000 Sciammarella ..... 715/727
6,103,965 A * 8/2000 Kumagai ..... 84/622
6,180,862 B1 * 1/2001 Hirano ..... 84/601
6,201,174 B1 3/2001 Eller
6,225,545 B1 * 5/2001 Suzuki et al. ..... 84/477 R
6,342,665 B1 1/2002 Okita et al.
6,359,632 B1 * 3/2002 Eastty et al. ..... 715/716
6,403,871 B2 6/2002 Shimizu et al.
6,429,863 B1 * 8/2002 LoPiccolo et al. ..... 345/419
6,626,954 B1 * 9/2003 Kamachi et al. ..... 715/236
6,686,529 B2 * 2/2004 Kim ..... 84/464 R
6,687,193 B2 2/2004 Jung
6,791,568 B2 * 9/2004 Steinberg et al. ..... 345/600
7,116,328 B2 * 10/2006 Kawai et al. ..... 345/473
7,129,927 B2 10/2006 Mattsson
7,212,213 B2 * 5/2007 Steinberg et al. ..... 345/589
7,504,572 B2 * 3/2009 Nakamura ..... 84/600
7,567,847 B2 7/2009 Basson et al.
7,601,904 B2 * 10/2009 Dreyfuss et al. ..... 84/600
7,608,774 B2 10/2009 Ohmura et al.
7,692,086 B2 * 4/2010 Nease et al. ..... 84/485 R
7,698,009 B2 * 4/2010 Cotey et al. ..... 700/94
7,709,723 B2 5/2010 Pachet et al.
7,742,609 B2 * 6/2010 Yeakel et al. ..... 381/119
7,774,707 B2 * 8/2010 Sim et al. ..... 715/727
7,805,685 B2 * 9/2010 Cannistraro et al. ..... 715/833
7,829,778 B2 * 11/2010 Gatzsche et al. ..... 84/615
7,899,565 B1 * 3/2011 Johnston ..... 700/94
7,928,311 B2 * 4/2011 Trivi et al. ..... 84/645
2002/0121182 A1 9/2002 Kondo et al.
2003/0159567 A1 8/2003 Subotnick
2005/0145098 A1 7/2005 Kondo et al.
2006/0207411 A1 9/2006 Ohmura et al.
2007/0163427 A1 7/2007 Rigopulos
2007/0256540 A1 11/2007 Salter
2008/0271591 A1 11/2008 Lemons
2009/0223352 A1 9/2009 Matsuda et al.
2009/0308231 A1 * 12/2009 Mizuhiki et al. ..... 84/622

OTHER PUBLICATIONS

Extended European Search Report issued Sep. 28, 2009 for corresponding EP application No. 09162338.9-2225.

* cited by examiner

ELECTRONIC MUSIC APPARATUS AND TONE CONTROL METHOD

CROSS REFERENCE TO RELATED APPLICATION

This is a divisional of and claims priority from U.S. patent application Ser. No. 12/483,914 filed Jun. 12, 2009, the content of which is incorporated herein by reference in its entirety.

BACKGROUND

The present invention relates to an electronic music apparatus and tone control method which control a tone color effect parameter, associated in advance with a control operating member, in response to operation of the control operating member. Particularly, the present invention relates to a technique which not only presents a screen allowing a user to intuitively control a tone color effect parameter while visually enjoying the tone color effect parameter control but also allows the user to easily associate a control operating member with a tone color effect parameter by use of the screen. The present invention relates also to a technique which allows the user to use the screen to freely and easily set a style of variation of tone color effect parameter control (i.e., style of control of the tone color effect parameter) responsive to operation of a control operating member capable of controlling a degree of effectiveness of the tone color effect parameter.

Among the conventionally-known electronic music apparatus, such as electronic musical instruments, are ones in which various tone-controlling tone color effect parameters, such as volume, pitch and LFO parameters, are associated in advance with a plurality of control operating members, such as modulation wheels and sliders, and in which, in response to operation of any one of the control operating members, control is performed on the parameter associated with the operated control operating member (more specifically, a control value of the parameter is determined). One example of such conventionally-known electronic music apparatus is disclosed in "MOTIF XS6/XS7/XS8 Owner's Manual", 2007, Yamaha Corporation, which was available from the Internet (http://www2.yamaha.co.jp/manual/pdf/emi/japan/synth/motifxs_ja_om_c0.pdf), and which will hereinafter be referred to as "the non-patent literature".

In the conventionally-known electronic music apparatus, such as the one disclosed in the non-patent literature, a parameter group called a controller set is included in tone color data prepared in advance on a per-tone-color basis. The parameter group is intended to associate control operating members, such as modulation wheels, with tone effect parameters that are objects of control by the control operating members, and set degrees of effectiveness of the tone effect parameters indicative of how much the parameters are to be controlled in response to operation of the corresponding control operating members, namely, so-called "depths" defining relationship between operation amounts of the control operating members and controlled amounts of the parameters. A plurality of controller sets defining relationship between the control operating members and the parameters, depths, etc. are stored so that a user can select any desired one of the controller sets. The terms "tone colors" are used herein to mean not only ordinary tone colors, such as piano and guitar tone colors, but also individual elements of tone colors so-called "tone color elements" for use when a "tone color" is to be composed of two or more tone color elements and tone color groups so-called "performances" each comprising a plurality of tone color elements or tone colors.

The conventionally-known electronic music apparatus, such as the one disclosed in the non-patent literature, are constructed in such a manner that, once a tone color effect parameter is associated with a control operating member in accordance with the above-mentioned controller set, a control value of the tone color effect parameter associated in advance with the control operating member is presented on a display. However, the conventionally-known electronic music apparatus only display the control value of the tone color effect parameter directly in a numerical value, meter indication or the like, so that a user of the electronic music apparatus can never perform tone color effect parameter control while visually enjoying the control. Further, because the conventionally-known electronic music apparatus can only display the control value in a mere numerical value, meter indication or the like, the user can not intuitively grasp, from the displayed control value, a degree of effectiveness of the parameter responsive to operation of the corresponding control operating member. Furthermore, the conventionally-known electronic music apparatus generally can not control a plurality of tone color effect parameters simultaneously or while sequentially changing between the tone color effect parameters in response to successive operation of a given control operating member; or, if they can at all, it is necessary for the user to perform in advance extremely complicated setting operation on the control operating member for that purpose, and such setting operation tends to be very difficult and cumbersome particularly for a beginner user.

Further, the conventionally-known electronic music apparatus are constructed in such a manner that, in response to a tone color effect parameter being associated with a control operating member in accordance with the above-mentioned controller set, a style of variation the control of the tone color effect parameter responsive to operation of the control operating member is set on the basis of a depth defined in the controller set. Such a style of variation of the tone color effect parameter control responsive to operation of the control operating member (also referred to as "style of control of the tone color effect parameter") determines a so-called degree of effectiveness of the parameter, i.e. how much the parameter can be controlled by how much operation amount of the control operating member; the style of control also includes increasing/decreasing of a control value of the parameter. Difference in the style of variation of the parameter control leads to a difference in an operational feeling which the user has during operation of the control operating member. However, the conventionally-known electronic music apparatus would present the problem that the user can not perform parameter control with a high freedom because the apparatus can set the style of variation only such that the controlled amount increases (or decreases) unidirectionally and monotonously in response to the operation amount of the control operating member, for example, as the control operating member is sequentially operated from a minimum (zero) operation amount to a maximum operation amount. Further, because the conventionally-known electronic music apparatus can only display a control value of a tone color effect parameter directly in a mere numerical value, meter indication or the like in response to operation of the corresponding control operating member as noted above, the user can not perform control of the tone color effect parameter while visually enjoying the control and can not intuitively grasp a degree of effectiveness of the parameter from the displayed content.

SUMMARY OF THE INVENTION

In view of the foregoing, it is an object of the present invention to provide an improved electronic music apparatus and tone control method which not only present a screen allowing a user to intuitively perform control of a tone color effect parameter while visually enjoying the control, but also allow the user to readily associate a control operating member with a tone effect parameter by use of the screen.

It is another object of the present invention to provide an improved electronic music apparatus and tone control method which not only present a screen allowing a user to intuitively perform control of a tone color effect parameter while visually enjoying the control, but also allow the user to freely and readily set a style of variation (or style of control), responsive to operation of a control operating member, of a tone color effect parameter by use of the screen.

In order to accomplish the above-mentioned object, the present invention provides an improved electronic music apparatus, which comprises: a control operating member; a display device that displays at least a first display object associated with the control operating member and a second display object associated with a tone color effect parameter; a display control section that controls variation of a displayed position of the first display object in accordance with operation of the control operating member; a determination section that determines a control value of the tone color effect parameter, associated with the second display object, in accordance with relationship between respective displayed positions of the first display object and the second display object; and a tone control section that performs tone control on the basis of the control value of the tone color effect parameter determined by the determination section.

According to the present invention arranged in the aforementioned manner, at least a first display object associated with a control operating member and a second display object associated with a tone color effect parameter are displayed on the display device, and variation of a displayed position of the first display object is controlled in accordance with operation of the control operating member. Control value of the tone color effect parameter associated with the second display object is determined in response to the displayed position of the first display object being varied so that relationship between the respective displayed positions of the first display object and the second display object varies, and consequently, tone control is performed on the basis of the thus-determined control value of the parameter. Namely, with the present invention, where the displayed position, on the display device, of the first object is varied, in response to operation of the control operating member, to move toward or away from the second display object associated with the tone color effect parameter, the user can enjoy controlling the tone color effect parameter while visually enjoying variation of positional relationship between the display objects.

In a preferred embodiment, effective area, representing a range over which parameter control is made effective, is set in the second display object displayed on the display device, and wherein the display control section associates in advance the first and second display objects in such a manner that control, by the control operating member associated with the first display object, of the tone color effect parameter associated with the second display object is made effective on condition that the first display object is located within the effective area, the determination section determining a control value of the tone color effect parameter in accordance with relationship between respective displayed positions, within the effective area, of the first display object, whose displayed position is controlled in accordance with operation of the control operating member, and the second display object. With such arrangements, the user can readily intuitively grasp establishment/cancellation of association between the control operating member and the tone color effect parameter, as well as relationship between the operation amount of the control operating member and the control value of the tone color effect parameter.

According to the present invention, where a control value of the tone color effect parameter is determined on the basis of relationship between the respective displayed positions of the first display object, whose displayed position is controlled in accordance with operation of the control operating member, and the second display object associated with the tone color effect parameter, the user can enjoy controlling the tone color effect parameter while enjoying viewing display object motions and intuitively grasp the control value of the tone color effect parameter from the positional relationship between the display objects. Further, because the control operating member and the tone color effect parameter are associated with each other on condition that the first display object is located within the effective area, the user can readily intuitively grasp not only relationship between the operation amount of the control operating member and the control value of the tone color effect parameter but also establishment/cancellation of association between the control operating member and the tone color effect parameter.

According to another aspect of the present invention, there is provided an improved electronic music apparatus, which comprises: a control operating member; a display device that displays at least a first display object associated with the control operating member and a second display object associated with a tone color effect parameter; a setting section that sets a path to be used as a display course of the first display object; a display control section that controls variation of a displayed position of the first display object, in accordance with operation of the control operating member, to move on and along the path set by the setting section; a determination section that determines a control value of the tone color effect parameter, associated with the second display object, in accordance with relationship between respective displayed positions of the first display object moving on and along the set path and the second display object; and a tone control section that performs tone control on the basis of the control value of the tone color effect parameter determined by the determination section. Here, a style of control of the tone color effect parameter to be performed according to operation of the control operating member is determined in accordance with the setting of the path.

According to the present invention arranged in the aforementioned manner, at least a first display object associated with a control operating member and a second display object associated with a tone color effect parameter are displayed on the display object, and variation of a displayed position of the first display object is controlled in accordance with operation of the control operating member. Variation of a displayed position of the first display object is controlled, in accordance with operation of the control operating member, to move on and along the path set by the setting section. Control value of the tone color effect parameter associated with the second display object is determined in response to the displayed position of the first display object being varied so that relationship between the respective displayed positions of the first display object and the second display object varies, and consequently, tone control is performed on the basis of the thus-determined control value of the tone color effect parameter. Namely, in the present invention, on the display device, of the first display object is limited to the set path and a control value of the tone color effect parameter is determined on the basis of relationship between the respective displayed positions of the first display object, movable only on and along the path, and the second display object. Thus, the control value of the tone color effect parameter varies depending on the set path even when the control operating member is operated in a fixed same manner. Thus, by merely appropriately setting the above-mentioned path, the user can freely and easily set a style of control of the tone color effect parameter responsive to operation of the control operating member capable of controlling a so-called degree of effectiveness of the parameter. Also, the user can enjoy controlling the tone color effect parameter while visually enjoying variation of positional relationship between the display objects.

Because displayable positions, on the display device, of the first display object are limited to the set path and a control value of the tone color effect parameter is determined on the basis of relationship between the respective displayed positions of the first and second display objects, the user can freely and easily set a style of control of the tone color effect parameter responsive to operation of the control operating member, by merely appropriately setting the above-mentioned path.

Further, because the first display object is displayed to move on and along the set path in accordance with operation of the control operating member, the user can enjoy controlling the tone color effect parameter while enjoying viewing motions of the first display object and intuitively grasp a degree of effectiveness of the parameter from the motion of the first display object.

The present invention may be constructed and implemented not only as the apparatus invention as discussed above but also as a method invention. Also, the present invention may be arranged and implemented as a software program for execution by a processor such as a computer or DSP, as well as a storage medium storing such a software program. Further, the processor used in the present invention may comprise a dedicated processor with dedicated logic built in hardware, not to mention a computer or other general-purpose type processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION

Figure 1:
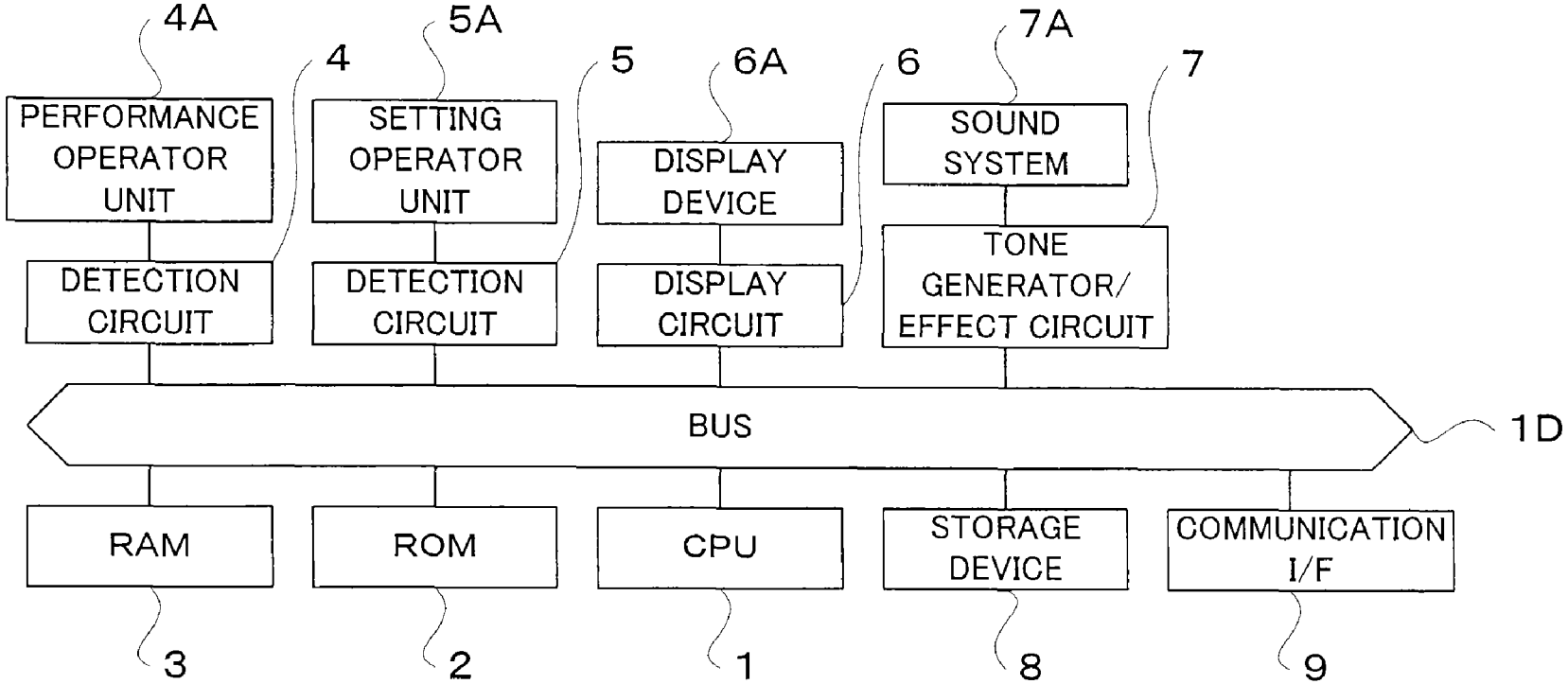
FIG. 1 is a block diagram showing an example general hardware setup of an electronic music apparatus in accordance with an embodiment of the present invention

FIG. 1 is a block diagram showing an example general hardware setup of an electronic music apparatus in accordance with an embodiment of the present invention. The electronic music apparatus of FIG. 1, which is for example an electronic musical instrument, is controlled by a microcomputer including a microprocessor unit (CPU) 1, a read-only memory (ROM) 2 and a random access memory (RAM) 3. The CPU 1 controls operation of the entire electronic music apparatus. To the CPU 1 are connected, via a data and address bus 1D, the ROM 2, RAM 3, detection circuits 4 and 5, display circuit 6, tone generator/effect circuit 7, storage device 8 and communication interface (I/F) 9. The CPU 1 has a timer (not shown) for counting various times, such as times to signal interrupt timing for timer interrupt processes. For example, the timer generates clock pulses and gives the generated clock pulses to the CPU 1 as processing timing instructions or as interrupt instructions. The CPU 1 carries out various processes in accordance with such instructions.

The ROM 2 stores therein various programs for execution by the CPU 1 and various data for reference by the CPU 1. The RAM 3 is used as a working memory for temporarily storing, for example, various data generated as the CPU 1 executes predetermined programs, as a memory for storing a currently-executed program and data related to the currently-executed program, and for various other purposes. Predetermined address regions of the RAM 3 are allocated to various functions and used as various registers, flags, tables, memories, etc. In the instant embodiment, the RAM 3 is used to store association information pertaining to a control operating member and a tone color effect parameter associated with each other and other information and data, as will be later described.

Performance operator unit 4A is, for example, a keyboard including a plurality of keys operable to select pitches of tones to be generated and key switches provided in corresponding relation to the keys. The performance operator unit (e.g., keyboard) 4A can be used not only for a manual performance by a user itself and but also as means for, for example, selecting a tone color and setting a tone color effect parameter. The detection circuit 4 detects depression and release of keys of the performance operator unit 4A to thereby produce detection outputs.

Figure 3:
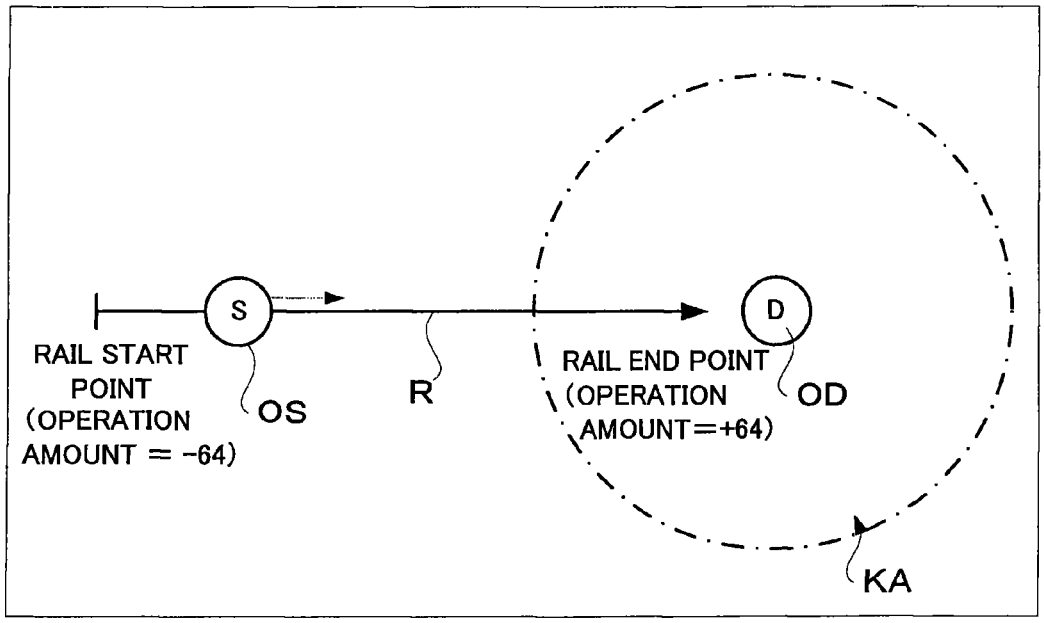
FIG. 3 is a conceptual diagram showing an example of a parameter control screen.

Setting operator unit 5A includes various operating members, such as: selection switches for selecting a desired tone color to be used in a performance; control operating members, like modulation wheels, pitch-bend wheels, after-touch control, knobs, sliders and a ribbon controller, for controlling various tone color effect parameters, like a volume, pitch and LFO parameters, in accordance with controlled amounts (e.g., 0-128, −64-+64, etc.) of the control operating members; and a screen editing switch for editing a later-described "parameter control screen" (see FIG. 3). Not only tone color effect parameters predetermined in response to selection of a controller set but also user-desired tone color effect parameters can be associated with the individual control operating members.

Of course, the setting operator unit 5A may also include a numeric keypad for inputting numeric value data for selecting, setting and controlling a tone pitch, color, effect, etc., keyboard for inputting characters and letters (text data), and various other operating members, such as a mouse operable (referred to as "two-dimensional pointing operating member") to manipulate or operate a predetermined pointing device displayed on a display device 6A for designating a position on any one of various screens. The detection circuit 5 detects an operating state of the setting operator unit 5A and outputs switch information, corresponding to the detected operating state, to the CPU 1 via the data and address bus 1D.

The display circuit 6 can display, on the display device 6A in the form of a liquid crystal display (LCD) panel, CRT or the like, not only various screens, such as the "parameter control screen" (see FIG. 3) but also various data stored in the ROM 2 and storage device 8, controlling state of the CPU 1, etc. By reference to various information displayed on the display device 6A, the user is allowed to readily select a music piece and a tone color to be used in a performance and perform setting of tone color effect parameters, etc. In the instant embodiment, the display device 6A may be in the form of a touch panel, in which case the electronic music apparatus of course includes a detection section that detects user's touching operation on the screen. In such a case, the display device (touch panel) 6A functions also as a two-dimensional pointing operating member (or object operating member) capable of varying a displayed position of each desired displayed object on the parameter control screen in a similar manner to the mouse etc.

The tone generator/effect circuit 7, which is capable of simultaneously generating tone signals in a plurality of tone generation channels, receives various performance information, supplied via the data and address bus 1D, and generates tone signals by performing tone synthesis on the basis of the received performance information. In the tone synthesis, various effects can be imparted to the tone on the basis of individual control values (parameter values) of set tone color effect parameters. Each tone signal generated by the tone generator/effect circuit 7 is audibly reproduced or sounded via a sound system 7A including an amplifier, speaker, etc. The tone generator/effect circuit 7 and sound system 7A may be constructed in any desired conventionally-known manner. For example, the tone generator/effect circuit 7 may employ any desired tone synthesis method, such as the FM, PCM, physical model or format synthesis method. Further, the tone generator/effect circuit 7 may be implemented by either dedicated hardware or software processing performed by the CPU 1.

The storage device 8 stores therein the above-mentioned controller sets, tone color parameter data (see FIG. 2) to be referred to when displaying the "parameter control screen" (see FIG. 3), various data, such as association information (to be described later) pertaining to control operating members and tone color effect parameters associated with each other, various programs to be executed by the CPU 1. In a case where a particular control program is not contained in the ROM, the particular control program may be stored in the storage device 8 so that, by reading the particular control program from the storage device 8 into the RAM 3, the CPU 1 is allowed to operate in exactly the same way as in the case where the particular control program is stored in the ROM 2. This arrangement greatly facilitates version upgrade of the control program, addition of a new control program, etc. The storage device 8 may use any of various recording media other than a hard disk (HD), such as a flexible disk (FD), compact disk (CD-ROM or CD-RAM), magneto-optical disk (MO) and digital versatile disk (DVD); alternatively, the storage device 8 may comprise a semiconductor memory, such as a flash memory.

The communication interface (I/F) 9 is an interface, such as RS-232C, USB (Universal Serial Bus), IEEE1394, Bluetooth (trademark) or infrared transceiver, which is equipped with functions as a MIDI input/output interface for communicating performance data of the MIDI format between the electronic music apparatus of the invention and external equipment (not shown) and as a data input/output interface for communicating various information, such as data other than MIDI data and control programs. Alternatively, the communication interface (I/F) 9 may be a network interface that can interconnect the electronic music apparatus of the invention and external equipment (e.g., server apparatus) on a network via a wired communication network, such as a telephone line network or a wireless communication network, and that can communicate MIDI data, various information, scripts, etc. between the electronic music apparatus of the invention and server apparatus. The communication interface 9 may be capable of both wired and wireless communication rather than either one of the wired and wireless communication.

Further, in the above-described electronic music apparatus, the performance operator unit 4A may be of any other type than the keyboard instrument type, such as a stringed instrument type, wind instrument type or percussion instrument type. Furthermore, needless to say, the electronic music apparatus is, of course, not limited to the type where the performance operator unit 4A, display device 6A, tone generator/effect circuit 7, etc. are incorporated together as a unit within the music apparatus. For example, the electronic music apparatus of the present invention may be constructed in such a manner that the above-mentioned sections are provided separately and interconnected via communication facilities such as a MIDI interface, various networks and/or the like. Moreover, the electronic music apparatus of the present invention may be implemented as any desired type of apparatus or equipment than an electronic musical instrument, such as a personal computer, portable (hand-held) phone or other portable communication terminal, karaoke apparatus or game apparatus as long as it can control tones in accordance with tone color effect parameters.

Figure 2:
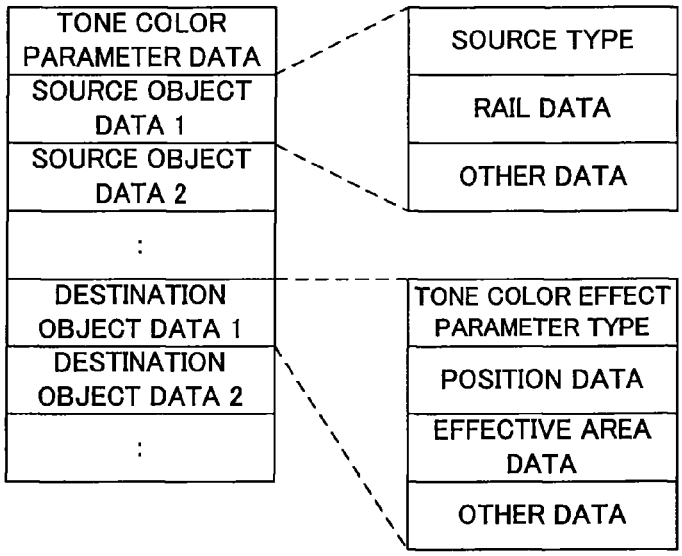
FIG. 2 is a conceptual diagram showing an example data organization of tone color parameter data used in the embodiment.

With reference to FIG. 2, the following describe tone color parameter data used in the instant embodiment. FIG. 2 is a conceptual diagram showing an example data organization of the tone color parameter data. The tone color parameter data are data for displaying the "parameter control screen" (see FIG. 3) on the display device 6A. A multiplicity of such tone color parameter data are stored in the storage device 8 on a per-tone-color basis, so that corresponding tone color parameter data are identified in response to user's selection of a desired tone color.

As shown in FIG. 2, the tone color parameter data of each of the tone colors generally comprise one or more source object data, and one or more destination object data. The source object data is information pertaining to a source object OS and rail object R (see FIG. 3) that can be displayed on the "parameter control screen", and it includes source type data, rail data and other data. The source type data is data defining a type of any one of the control operating members provided on the music apparatus, such as modulation and pitch-bend wheels, after-touch control, knobs, sliders and ribbon controller, which is to be associated with a source object to be displayed on the screen. The rail data is data characterizing a display style of a rail object that is to be displayed in a paired combination with a source object OS. The rail data defines, for example, a start point position indicative of a display start position of the rail object and an end point position indicative of a display end position of the rail object (more specifically, coordinates of the start and end positions on the screen), line type (e.g., straight line, curved line, broken line, closed curve or a combination of these lines) of the rail object R, and, if the line type is a curved line, broken line or closed curve, one or more intermediate displayed positions (coordinates) etc. The other data defines a display style (e.g., shape, displayed color, etc.) of the source object OS, an initial displayed position (coordinates), etc.

The destination object data is information pertaining to a destination object OD (see FIG. 3) capable of being displayed on the "parameter control screen", which includes tone color effect parameter type data, effective area data and other data. The tone color effect parameter type data is data defining a type of any one of various tone color effects to be associated with the destination object OD; more specifically, it defines any one or more of tone color effects, such as a volume, pitch and LFO, that can be imparted to a tone in the tone generator/effect circuit 7 provided in the electronic music apparatus. The effective area data is data designating, for example, a size, shape (that may be a circular shape, star shape, elliptical shape or the like), etc. characterizing an effective area KA defined on the screen per each of the destination objects OD. The other data define a display style (e.g., shape, display color, etc.), initial display position (coordinates), etc.

FIG. 3 is a conceptual diagram showing an example of the "parameter control screen" displayed on the display device 6A on the basis of the above-mentioned tone color parameter data. Although the parameter control screen is capable of simultaneously displaying a plurality of source objects OS (each displayed in a paired combination with a rail object OD), the parameter control screen is shown in the figure as displaying one source object OS (and one rail object R paired with the source object OS) and one destination object OD, for simplicity and ease of understanding. Namely, the user may select any desired source object OS and destination object OD to be displayed on the parameter control screen, and only necessary objects are displayed on the screen with reference to the object data corresponding to the user's selection from among the tone color parameter data.

On the parameter control screen of FIG. 3, are displayed a source object (first display object) OS and rail object R based on the source object data, and a destination object (second display object) based on the destination object data. The source object OS may be displayed in a graphic representation of a circular shape or any other desired shape, such as a polygonal or star shape, or in any other desired form of graphic representation, such as an icon emulating the shape of the control operating member associated with (or corresponding to) the source object OS. Further, although omitted in the illustrated example, the name, abbreviated name, symbol and/or the like of the control operating member associated with the source object OS may be displayed in place of or in addition to the graphic representation. Further, in the case where a plurality of source objects OS are displayed at the same time, each of the source objects OS may be displayed in a different display style, e.g. different color and different shape. The destination object OD may be displayed in a suitable shape, similarly to the source object OS. Further, the name etc. of the tone color effect parameter associated with the destination object OD may also be displayed.

The source object OS indicates a control source capable of controlling any one of various tone color effect parameters, and one of the control operating members, such as modulation and pitch-bend wheels, after-touch control operating member, knobs, sliders and a ribbon controller, can be associated as such a control source. The rail object R, which is displayed in a pair with the source object OS, defines a track or path along which the source object OS associated with the rail object R is to be moved on the screen in response to operation of the control operating member. Namely, the display of the source object OS is controlled in such a manner that the source object OS moves on along the rail object R in response to operation of the control operating member. More specifically, in the instant embodiment, the display of the source object OS is controlled to move on and along the rail object R by an amount corresponding to increase/decrease in the operation amount of the corresponding control operating member, more specifically in such a manner that the source object OS is located at the rail start point when the operation amount of the corresponding control operating member is the minimum (e.g., 0, −64 or the like) and located at the rail end point when the operation amount of the corresponding control operating member is the maximum (e.g., 128, +64 or the like); that is, correspondence relationship between the predetermined positions on the line of the rail object R and the operation amounts (−64 to +64) of the control operating member is defined in advance such that the source object OS is located as above. Namely, because the length of the line of the rail object R indicates the entire range over which the control operating member is movable, the user can readily grasp, from the current displayed position of the source object OS on the rail object R, to what extent the corresponding control operating member has been moved.

Further, the destination object OD is associated with any one of various tone color effects, such as a volume, pitch, LFO and vibrato, capable of being imparted to tones, and it indicates a control value of the tone color effect parameter determined according to operation of the corresponding control operating member (or operation of the source object OS). Each of the destination objects OD has a separate effective area KA, and this effective area KA represents a boundary or range in accordance with which the control operating member associated with the source object OS and the tone color effect parameter associated with the destination object OD are associated or such association is canceled (i.e., patching is established or canceled). Such an effective area KA may be displayed or may not be displayed on the screen. When the source object OS is located outside the effective area KA, it means that the above-mentioned association is currently not established, while, when the source object OS is located inside or within the effective area KA, it means that the above-mentioned association is currently established.

The user can operate the two-dimensional pointing operating member (or object operating member), such as the mouse, to change as desired the displayed position, display style, etc. of any desired one of the source objects OS, rail objects R, destination objects OD and effective areas KA. Basically, as the displayed position of the source object OS or rail object R is changed (moved), the displayed position of the rail object R or source object OS displayed in paired relation to the source object OS or rail object R is also changed (moved). However, if desired, only the source object OS can be moved to another position independently of (or separately from) the rail object R, as will be later described in detail in relation to (h) of FIG. 4.

The rail object R can be changed in its displayed orientation, line length (and hence the rail start point position and/or rail end point position), shape, etc. While the rail object R is fundamentally displayed in a continuous straight line, it may be other than a straight line as seen in (c) of FIG. 5, or may be discontinuous lines as seen in (d) of FIG. 5. Further, the range of the effective area KA is expandable and contractable as desired. If the line length of the rail object R is changed or the effective areas KA is expanded or contracted, then the operating range of the corresponding control operating member, where the control operating member can control the parameter, would be limited accordingly, as will be later described. Needless to say, if the displayed position and/or displayed orientation of the rail object R is changed, then the displayed position of the source object OS displayed in paired relation to the rail object R is also changed. Needless to say, if the displayed position, display style or the like of any one of the objects on the parameter control screen has been changed, the corresponding object data of the tone color parameter data is updated. Further, if the line length of the rail object R has been changed, the correspondence relationship between the operation amount of the control operating member and the displayed moved amount of the source object OS on the rail object R is also changed. The correspondence relationship may be defined in any desired form, e.g. in predetermined arithmetic expressions, table or the like prepared per type of the control operating members.

Patching (i.e., association) between a control operating member and a tone color effect parameter can be established by operating the control operating member, by operating only the two-dimensional pointing operating member (object operating member), such as the mouse, without operating the control operating member, or by first operating the two-dimensional pointing operating member and then operating the control operating member. When such patching has been established, association information (not shown) pertaining to the mutually-associated control operating member and tone color effect parameter is generated and stored into the RAM 3 or the like. The association information includes data indicating the mutually-associated control operating member and tone color effect parameter, displayed positions of the source object OS and destination object OD corresponding to the control operating member and tone color effect parameter, a distance (display interval) between the displayed positions of the source object OS and destination object OD, etc. Note that the association information may be deleted from the RAM 3 or the like when the patching is canceled.

Figure 4:
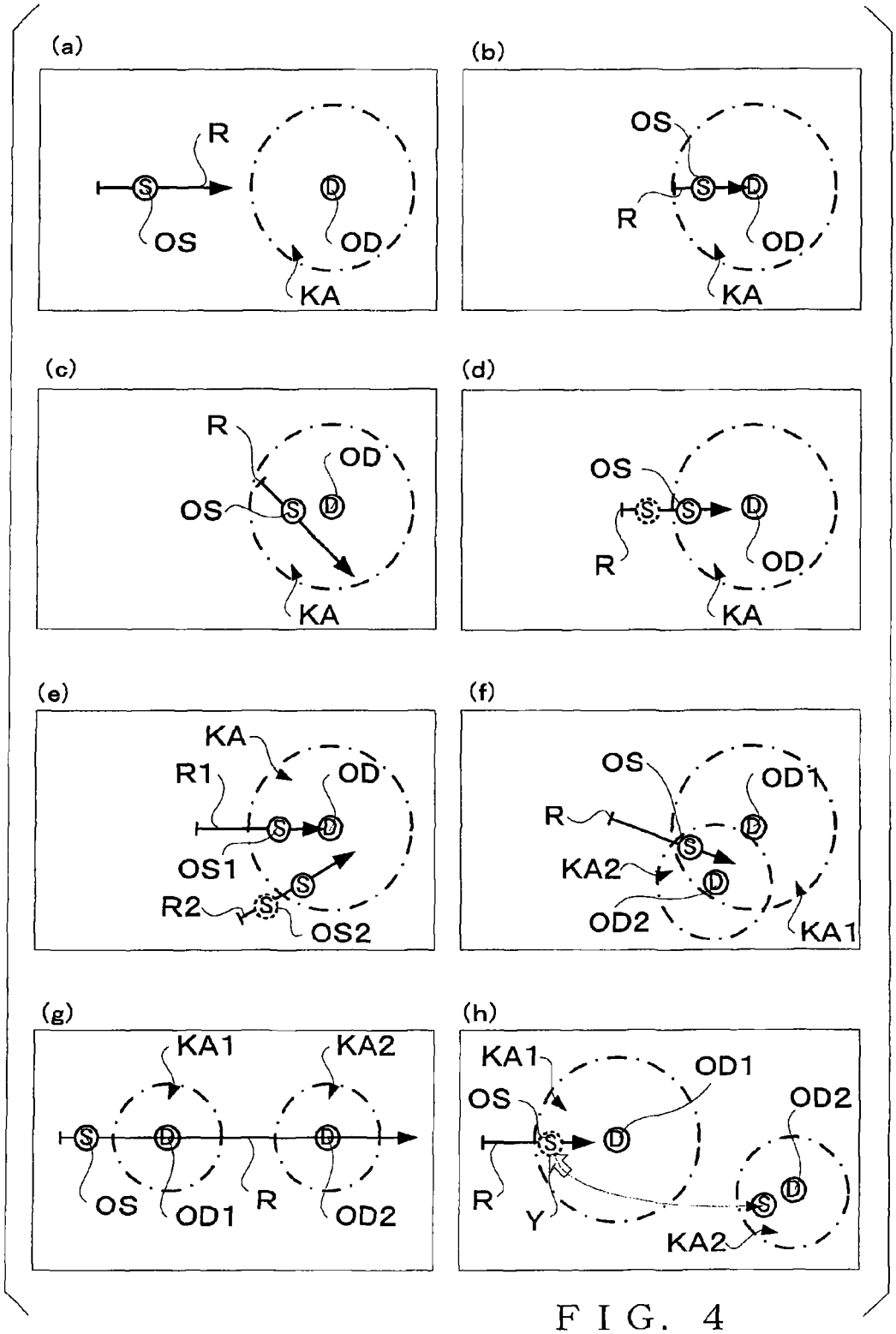
FIG. 4 is a conceptual diagram outlining how patching is established on the parameter control screen.

Now, a description will be given about an example manner in which patching between a control operating member and a tone color effect parameter is established and canceled. FIG. 4 is a conceptual diagram outlining how patching between a control operating member and a tone color effect parameter is established on the parameter control screen shown in FIG. 3. (a) of FIG. 4 shows an example where neither a source object OS nor a rail object R is located within an effective area KA, and (b) and (c) of FIG. 4 each show an example where an entire rail object R is located within an effective area KA along with a source object OS. In the example of (b) of FIG. 4, the rail object R is oriented toward the center of a destination object OD, but, in the example of (c) of FIG. 4, the end point of the rail object R is not oriented toward the center of a destination object OD. (d) of FIG. 4 shows an example where part of a rail object R is located within the effective area KA.

When the source object OS and the rail object R are moved out of the effective area KA by operation of the two-dimensional pointing operating member as shown in (a) of FIG. 4, no patching is established. In this case, even if the control operating member is operated following the operation of the two-dimensional pointing operating member, no patching can be established because the source object OS moving along the rail R never goes into the effective area KA no matter how the control operating member is operated. In this case, patching can be established by the source object OS and the rail object R (or the destination object OD and effective area KA), displayed as shown in (a) of FIG. 4, being clicked and dragged by the user to their respective displayed positions shown in (b) or (c) of FIG. 4, i.e. the positions where the source object OS is located within the effective area KA. Conversely, the patching can be canceled by the source object OS and the rail object R (or the destination object OD and effective area KA), displayed as shown in as shown in (b) or (c) of FIG. 4, being clicked and dragged by the user to their respective displayed positions shown in (a) of FIG. 4. In this manner, the user can also establish/cancel patching by only operating the two-dimensional pointing operating member, i.e. without operating the control operating member.

Further, if the source object OS and the rail object R (or the destination object OD and effective area KA) displayed as shown in (a) of FIG. 4 are clicked and dragged by the user but such click and drag operation is stopped partway in a state where part of the rail object R is located within the effective area KA with the source object OS located outside the effective area KA as indicated by dotted line, then no patching can be established. In this case, however, patching can be established by the user further operating the control operating member, associated with the source object OS, following the operation of the two-dimensional pointing operating member until the source object OS is moved into the effective area KA as indicated by solid line. Conversely, the patching can be canceled by the user operating the control operating member until the source object OS is moved out of the effective area KA.

(e) of FIG. 4 shows an example where respective portions of a plurality of rail objects R1 and R2 are located within an effective area KA of one destination object OD (one destination object OD is patched by the plurality of rail objects R1 and R2). As noted above, patching is established once a source object is moved into the effective area KA in response to operation of the corresponding control operating member. However, in a case where one of the source objects OS1 is already located within the effective area KA so that patching is already established for the one source object OS1, and if the other source object OS2 has been entered into the effective area KA, patching is established for the other source object OS2 having entered the effective area KA (namely, patching is established on a "last-come-first-served" basis). For example, if the source object OS2 is entered into the effective area KA (i.e., moved from the broken-line position to the solid-line position) even though the source object OS1 is already located within the effective area KA, patching is established for the source object OS2 while the patching for the source object OS1 is canceled. In a case where the two source objects OS1 and OS2 are located within the effective area KA, patching may be established for one of the source objects OS1 or OS2 having been moved in response to most recent user's operation. If the user operates the corresponding control operating member until the source object OS2 is moved out of the effective area KA, then the patching for the source object OS2 is canceled, while the patching for the source object OS1 is re-established. In this manner, the instant embodiment can prevent a same parameter from being controlled via two control operating members. In an alternative, patching may be established for both of the two source objects OS1 and OS2*a*, and a value of only one of the source objects OS1 or OS2 which has been moved in response to most recent user's operation may be employed.

In order to avoid the display state shown in (e) of FIG. 4, the instant embodiment may be constructed in such a manner that, even when the user attempts to click and drag a further rail object, e.g. in the display state shown in (d) of FIG. 4, at the time of screen editing, it inhibits such an attempt; namely, in this case, priority is given to currently-established patching.

(f) of FIG. 4 shows an example where one source object OS is simultaneously entered into respective effective areas KA1 and KA2 of two destination objects OD1 and OD2 (i.e., where the plurality of destination objects OD1 and OD2 and patched simultaneously). In this case, as the one source object OS is simultaneously entered into the respective effective areas KA1 and KA2 in response to operation of the control operating member, patching is established for the source object OS with respect to both of the destination objects OD1 and OD2. If the control operating member is operated until the source object OS is moved out of the effective areas KA1 and KA2, the patching can be canceled simultaneously with respect to both of the destination objects OD1 and OD2. In this manner, the instant embodiment can simultaneously control two parameters with one control operating member. In this case, respective control values of the parameters are determined in accordance with distances (i.e., display intervals) between the displayed source object OS and the displayed destination objects OD1 and OD2.

(g) of FIG. 4 shows an example where one source object OS is sequentially entered into respective effective areas KA1 and KA2 of two destination objects OD1 and OD2. In this case, the source object OS sequentially traverses the effective areas KA1 and KA2 as it moves in a left-to-right direction of the figure in response to operation of the control operating member. At that time, patching between the source object OS and the destination object OD1 is established once the source object OS enters the effective area KA1, and the patching between the source object OS and the destination object OD1 is canceled once the source object OS moves out of the effective area KA1. Then, as the source object OS further moves in the left-to-right direction of the figure in response to further operation of the control operating member, patching between the source object OS and the destination object OD2 is established once the source object OS enters the effective area KA2, and the patching between the source object OS and the destination object OD2 is canceled once the source object OS moves out of the effective area KA2. In this case, a different parameter can be controlled via one control operating member per each of predetermined operating ranges.

(h) of FIG. 4 shows an example where only a source object OS located within one effective area KA1 is detached from a rail object R and moved into another effective area KA2. In this case, because the source object OS (indicated by broken line in the figure) designated (clicked) by a pointer Y before the movement has been located within the effective area KA1, patching between the source object OS and the destination object OD1 has already been established. Then, by the movement via drag operation, patching between the source object OS and another destination object OD2 is temporarily established because the source object OS is located within the other effective area KA2; in this case, to output a control value of the parameter temporarily associated with the destination object OD2 is output, a control value of the parameter is determined in accordance with a current distance between the source object OS and the destination object OD2. Once the control operating member is operated in such a state, the source object OS is moved back to a predetermined position on the rail object where it was located immediately before the movement, so that patching between the source object OS and the destination object OD1 is established again and the patching between the source object OS and another destination object OD2 is canceled.

As set forth above, the instant embodiment of the electronic music apparatus can not only move a source object OS, rail object R, destination object OD and effective area KA to desired displayed positions on the screen in response to user's operation of a suitable user interface, such as the aforementioned two-dimensional pointing operating member, but also move a source object OS on and along a rail object R in response to user's operation of the corresponding control operating member. Further, when a source object OS is located within an effective area KA, association (patching) is established between the control operating member associated with the source object OS and a tone color effect parameter associated with the destination object OD having the effective area KA. Once the source object OS is moved out of the effective area KA by operation of the user interface and/or control operating member, the association (patching) between the control operating member and the tone color effect parameter is canceled.

After the establishment of the above-mentioned association between the control operating member and the tone color effect parameter, not only the source object OS is moved on and along the rail object R in response to further operation of the control operating member, but also a tone color effect parameter is determined in accordance with a control value predetermined in correspondence with a distance (display interval) between the displayed position of the source object OS located within the effective area KA and the displayed position of the destination object OD.

Figure 5:
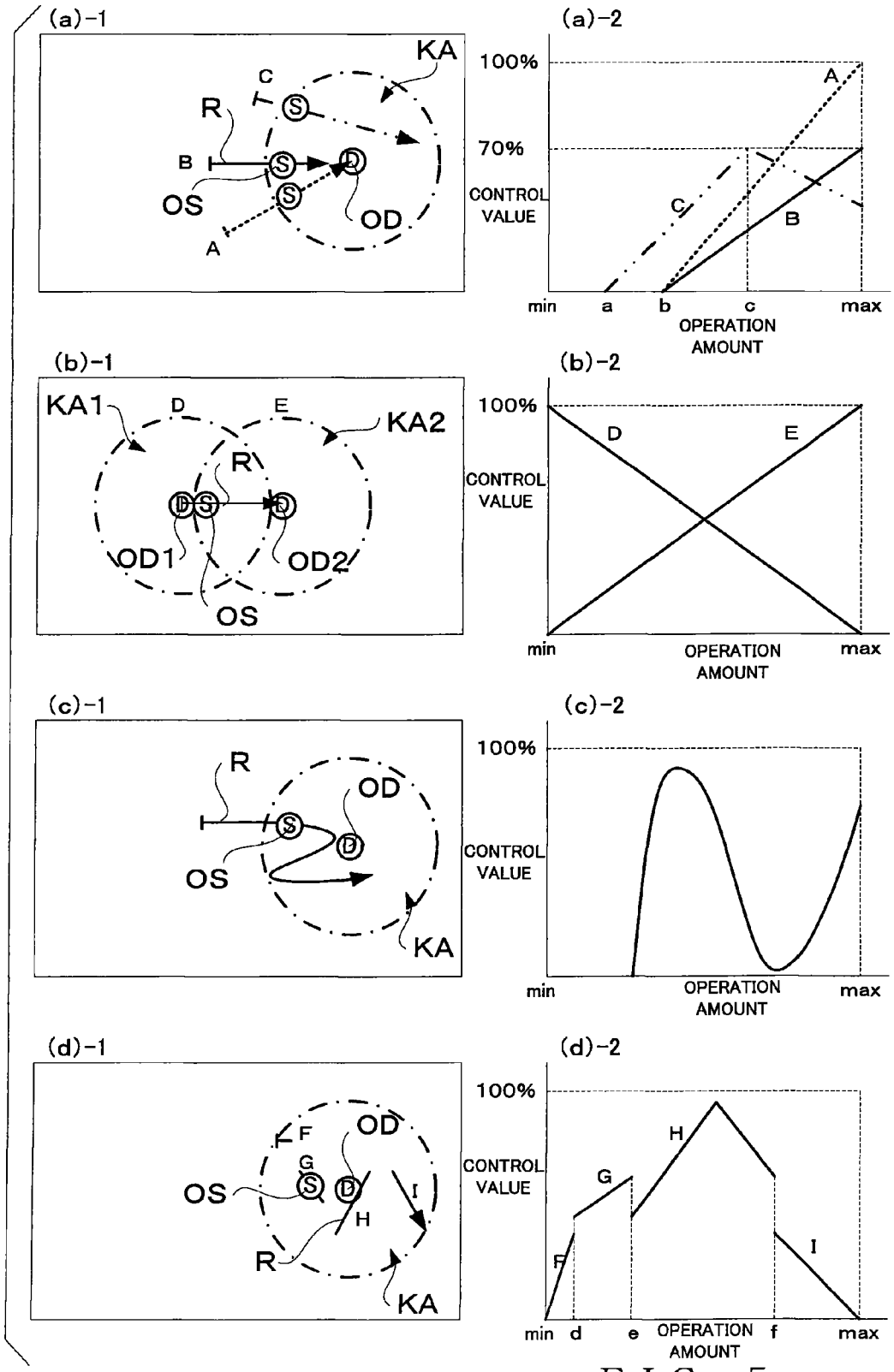
FIG. 5 is a conceptual diagram explanatory of tone color effect parameter control using the parameter control screen.

With reference to FIG. 5, the following paragraphs describe tone color effect parameter control using the parameter control screen.

FIG. 5 is a conceptual diagram explanatory of the tone color effect parameter control using the parameter control screen of FIG. 3. In each of (a)-(d) of FIG. 5, the parameter control screen is shown in a left section (suffixed with a sub number "−1") of the figure, while a graph showing relationship between an operation amount of a control operating member and a control amount of a tone color effect parameter is shown in a right section (suffixed with a sub number "−2").

(a) −1 and (a) −2 of FIG. 5 are views explanatory of tone color effect parameter control for three display patterns (A, B and C). In (a) of FIG. 5, the A pattern is where the rail end point of a rail object R is located at a center position of a destination object OD, the B pattern is where the rail end point of a rail object R is located short of the center position of the destination object OD, and the C pattern is where the rail end point of a rail object C is not oriented toward the center of the destination object OD. In each of these patterns, patching is established once a source object OS enters an effective area KA in response to operation of the control operating member and then a control value of the parameter is determined in response to further operation of the control operating member; namely, the parameter control is started once a predetermined operation amount for the patching establishment of the control operating member is exceeded.

If the A pattern (or B pattern) and the C pattern are compared, it may be seen that there are differences between the two patterns in the operation amount at which the parameter control is started and in the operation amount range over which the parameter control is permitted or made effective. Such differences occur due to a difference between lengths of portions of the rails R located outside of the effective area KA. Namely, the smaller the length of the portion of the rail R located outside of the effective area KA, the sooner patching is established, i.e. patching is established when the operation amount is smaller (e.g., closer to 0, −64 or the like) (see points "a" and "b" in (a) −2 of FIG. 5); thus, in this case, the operating range of the control operating member over which the parameter control is made effective can be made greater. Namely, the parameter control is made effective only within part of the operating range of the control operating member.

In a case where the rail object R is completely located within the effective area KA from the beginning like the one illustrated in (b) of FIG. 4, on the other hand, the parameter control is made effective over the entire operating range of the control operating member.

Further, if the A pattern, B pattern and C pattern are compared, it may be seen that there are differences in the control value variation amount responsive to the controlled amount (i.e., degree of effectiveness of the parameter which is indicated as an inclination of a curve in the graph). Such differences occur due to differences among the end point positions of the rail object rails R. The remoter the end point position of the rail object rail R is from the center of the destination object OD, the smaller the control value variation amount. Further, if the control value variation amount responsive to the controlled amount is very small, then the control value will not be determined up to the maximum value (here, displayed as "100%") of a predetermined control amount range even when the operation amount is the maximum. In the case of the C pattern, the control value increases in response to the operation amount until the operation amount reaches an amount "c", after which, however, the control value decreases in response to the operation amount. This is because, in the case of the C pattern, the source object OS moves toward the center of the destination object OD until the operation amount "c" is reached and moves away from the center of the destination object OD after the operation amount "c" is reached. In the illustrated example, a distance from the rail end point to the center of the destination object OD in the B pattern is set to equal a distance from a position of the source object OS, when the source object OS is located closest to the center of the destination object OD, to the center of the destination object OD in the C pattern; thus, the maximum control value of the B pattern and the maximum control value of the C pattern are set to equal each other.

From the foregoing description, it will be apparent to one skilled in the art that, in editing the parameter control screen, the user can change as desired the style of the parameter control responsive to operation of a control operating member, by adjusting any of the start/end point positions and orientation of a rail object R (including a distance to the center of a destination object OD), lengths of lines of the rail object R located within and outside an effective area KA, etc.

(b) of FIG. 5 shows an example where, in and around a mutually-overlapping region of two effective areas KA1 and KA2, a rail has its start point located at the center of one destination object OD1 and has its end point located at the center of another destination object OD2. In this case, prior to the start of operation of a control operating member, a source object OS is located close to the center of the destination object OD1 and located remote from the center of the other destination object OD2. Then, in response to operation of the control operating member, the source object OS moves away from center of the destination object OD1 and toward the center of the other destination object OD2. Thus, the control value for the destination object OD1 sequentially decreases, while the control value for the destination object OD2 sequentially increases. Further, because the source object OS moves on and along one rail object R, the control value decrease and increase amounts (rates) are identical to each other. Thus, in the case of (b) of FIG. 5, the user can perform cross-fade control on two different parameters by operation of a single control operating member.

(c) of FIG. 5 shows an example where a rail object R has a curved shape rather than a straight line shape. (d) of FIG. 5 shows an example where a rail object R has a discontinuous straight line shape (comprising four separate straight lines F, G, H and I in the illustrated example) rather than a continuous straight line shape. In the illustrated examples of (c) and (d) of FIG. 5, the operated-amount-versus-control-value variation style (e.g., inclination of the variation amount and decrease/increase of the control amount) changes in accordance with the shape of the rail object R. In the case where the rail object R has a curved shape and partly extending toward a destination object OD and partly extending away from the destination object OD as shown in (c) of FIG. 5, the control value responsive to the controlled amount presents variation similar to that of the rail object R. In the case where the rail object R has a discontinuous straight line shape as shown in (d) of FIG. 5, the control value can be greatly varied at points (points "d", "e" and "f" in (d)-2 of FIG. 5) where the rail object R breaks, even if variation in the operation amount at these points is very small.

Figure 6:
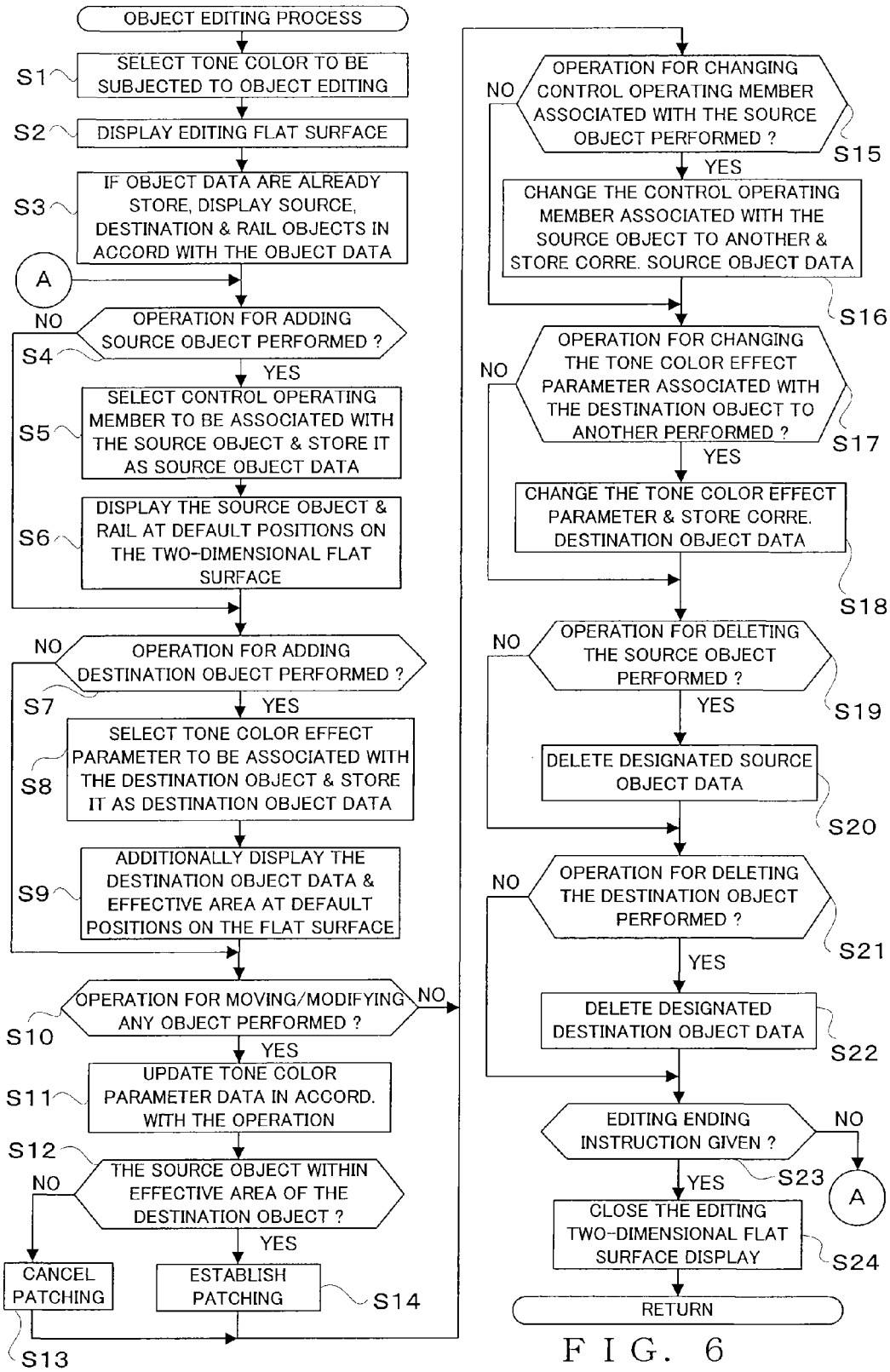
FIG. 6 is a flow chart showing an example operational sequence of an object editing process.

Next, with reference to FIG. 6, a description will be given about screen editing processing performed, as a preparation for parameter control, for creating/editing a "parameter control screen" for each tone color which includes, for example, one or more of the display styles shown in FIGS. 4 and 5. FIG. 6 is a flow chart showing an example operational sequence of an "object editing process" for implementing creation/editing of a parameter control screen, which is started in response to user's operation of a screen editing switch.

At step S1, a selection is made of a tone color to be subjected to object editing, i.e. a tone color for which a parameter control screen is to be created/edited. More specifically, a tone color is selected, in response to user's operation of a tone color selecting switch, from among a multiplicity of tone colors prepared in advance in the electronic music apparatus. At next step S2, a screen-editing two-dimensional flat surface is displayed on the display device 6A. If tone color parameter data (see FIG. 2) of the selected tone color have object data already stored therein, then a source object OS, rail object R and destination object OD (and effective area KA) are displayed so as to be reflected in the screen-editing two-dimensional flat surface, at step S3. Namely, a tone color parameter data set is specified, in accordance with the selection of the tone color, from among a multiplicity of tone color parameter data sets. If object data are already included in the specified tone color parameter data set, it means that data pertaining to individual objects prepared in a previous creation/editing process are currently stored, and thus, a parameter control screen created/edited in the previous process is reproduced and displayed on the display device 6A as the screen-editing two-dimensional flat surface.

At following step S4, a determination is made as to whether the user has performed operation for adding a source object OS through manipulation of a predetermined switch or the like. If no such source-object adding operation has been performed (NO determination at step S4), control jumps to step S7. If, on the other hand, any source-object adding operation has been performed (YES determination at step S4), a control operating member to be associated with the source object to be added is selected, and information pertaining to the source object OS to be additionally displayed at a default position and the selected control operating member is stored as source object data, at step S5. Then, the source object OS and a rail object R are additionally displayed at default positions on the screen-editing two-dimensional flat surface, at step S6.

At step S7, a determination is made as to whether the user has performed operation for adding a destination object OD. If no such destination-object adding operation has been performed (NO determination at step S7), control jumps to step S10. If, on the other hand, any destination-object adding operation has been performed (YES determination at step S7), a tone color effect parameter to be associated with the destination object to be added is selected, and information pertaining to the destination object OD (including an effective area KA of a default range) to be additionally displayed at a default position and the selected tone color effect parameter is stored as destination object data, at step S8. Then, the destination object OD and effective area KA are additionally displayed at default positions on the screen-editing two-dimensional flat surface, at step S9.

At step S10, a determination is made as to whether the user has performed operation for moving/modifying any of the source object OS, rail object R, destination object OD and effective area KA. If no such object moving/modifying operation has been performed (NO determination at step S10), control jumps to step S15. If, on the another hand, any such object moving/modifying operation has been performed (YES determination at step S10), the tone color effect parameter data are updated in accordance with the object moving/modifying operation, at step S11. If the object moving/modifying operation has been performed such that the source object OS enters the effective area KA (YES determination at step S12), then patching is established and corresponding association information is generated, at step S14. If, on the other hand, the object moving/modifying operation has been performed such that the source object OS, having so far been located within the effective area KA, gets out of the effective area KA (NO determination at step S12), then patching is canceled and the corresponding association information is erased, at step S13. Note that, if the object moving/modifying operation has been performed such that the source object having so far been located at a position outside the effective area KA, is located at another position outside the effective area KA, then the "non-patched" state of the source object is maintained.

At step S15, a determination is made as to whether the user has performed operation for changing the control operating member associated with the source object OS, i.e. for changing one control operating member, having so far been associated with the source object OS, to another control operating member. With a YES determination at step S15, the control operating member associated with the source object OS is changed to the other control operating member, so that the change of the control operating member is set and the corresponding source object data is stored, at step S16. At next step S17, a determination is made as to whether the user has performed operation for changing the tone color effect parameter associated with the destination object OD, i.e. for changing one tone color effect parameter, having so far been associated with the destination object OD or having so far been the target of the control, to another tone color effect parameter. With a YES determination at step S17, the tone color effect parameter associated with the destination object OD is changed to the other tone color effect parameter, so that the tone color effect parameter change is set and the corresponding destination object data is stored, at step S18.

Further, at next step S19, a determination is made as to whether the user has performed operation for deleting the source object OS from the screen. With a YES determination at step S19, the designated source object data is deleted at step S20. Thus, not only the display of the source object OS is erased from the screen, but also the rail object R attached to the source object OS is erased from the screen. At next step S21, a determination is made as to whether the user has performed operation for deleting the destination object OS from the screen. With a YES determination at step S21, the designated destination object data is deleted at step S22. Thus, the display of the destination object OD is erased from the screen. Needless to say, the patching is canceled if any one of the source object OS and destination object OD has been deleted in the aforementioned manner. At next step S23, a determination is made as to whether an editing ending instruction has been given. If no editing ending instruction has been given as determined at step S23, control reverts to step S4 to repeat the aforementioned operations. If such an editing ending instruction has been given (YES determination at step S23), the display of the editing two-dimensional flat surface is closed at step S24, after which the object editing process is brought to an end.

Figure 7:
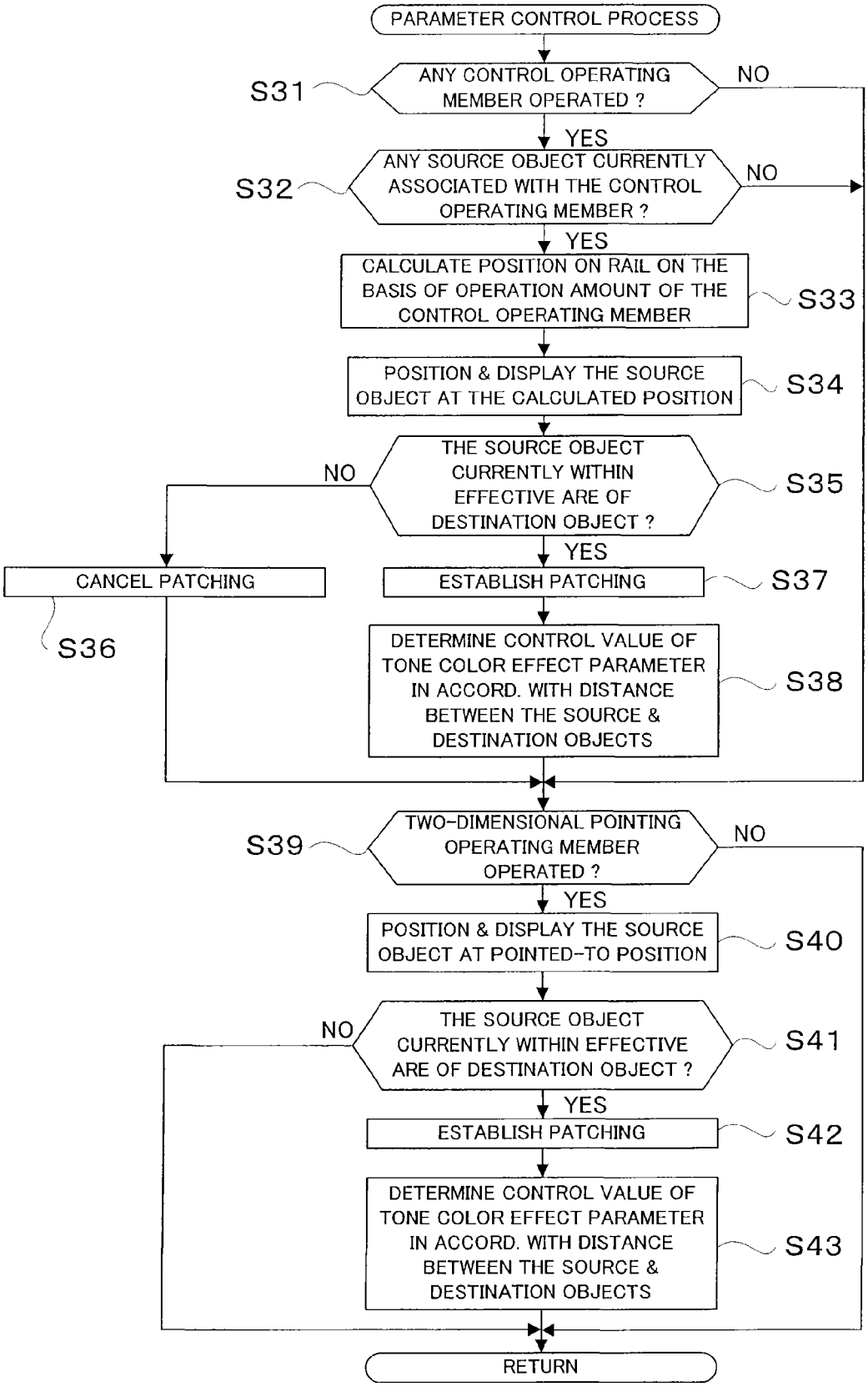
FIG. 7 is a flow chart showing an example operational sequence of a parameter control process.

Next, with reference to FIG. 7, a description will be given about specific processing for implementing the above-described patching establishment/cancelation and parameter control in response to the user operating control operating members while viewing the parameter control screen (see FIGS. 3-5) displayed on the display device. FIG. 7 is a flow chart showing an example operational sequence of a "parameter control process", which is a so-called interrupt process that is started in response to activation of the electronic musical apparatus and executed periodically every predetermined short time (e.g., 2 ms). Needless to say, the parameter control screen is displayed in advance prior to the execution of the parameter control process.

At step S31, a determination is made as to whether the user has operated any one of the control operating members. With a NO determination at step S31, control jumps to step S39. If the user has operated any one of the control operating members (YES determination at step S31), a further determination is made, at step S32, as to whether any source object OS is currently associated with the operated control operating member. With a NO determination at step S31, control jumps to step S39. If any source object OS is currently associated with the operated control operating member (YES determination at step S32), a corresponding position, on the rail object R, of the source object OS, is calculated on the basis of an operation amount of the control operating member, at step S33. Then, at step S34, the source object OS is displayed at the calculated position on the rail object R. Namely, the source object OS is displayed as moving on and along the rail object R to the calculated position. Needless to say, if the predetermined control operating member has been operated while the source object OS is detached from the rail object R so that patching is established between the source object OS and another destination object OD is temporarily established (see (h) of FIG. 4), then the source object OS is positioned and displayed at a corresponding position on the original rail object R in response to the operation of the control operating member.

At step S35, a determination is made as to whether the source object OS having moved on and along the rail object R is currently located within the effective area KA of a destination object OD. With a NO determination at step S35, and if patching has already been established for the source object OS, then the patching is canceled and the corresponding association information is deleted, at step S36. If, on the other hand, the source object OS is currently located within the effective area KA of the destination object OD (YES determination at step S35), and if no patching has been established yet for the source object OS, patching is established and corresponding association information is generated, at step S37. Further, a control value of the corresponding tone color effect parameter is determined in accordance with a distance (display interval) between the source object OS and the destination object OD included in the generated association information, and the thus-determined control value is supplied to the tone generator/effect circuit 7, at step S38. In this way, a predetermined effect corresponding to the user's operation amount of the control operating member is imparted to a tone.

At step S39, a determination is made as to whether the user has operated the two-dimensional pointing operating member, such as a mouse, to detach and move only any source object OS from a rail object R. With a NO determination at step S39, the parameter control process is brought to an end. If, on the other hand, the user has operated the two-dimensional pointing operating member to detach and move only any source object OS from a rail object R (YES determination at step S39), the source object OS is put and displayed at a position pointed to by the pointing operating member, at step S40. At step S41, a further determination is made as to whether the source object OS is now located within the effective area KA of a destination object OD. If the source object OS is not located within the effective area KA of any destination object OD (NO determination at step S41), the parameter control process is brought to an end. Note that, if the source object OS has moved out of the effective area KA of any destination object OD, patching of the source object OS is canceled.

If, on the other hand, the source object OS is now located within the effective area KA of any destination object OD (YES determination at step S41), patching is temporarily established for the destination object OD at step S42. Further, in this case, a control value of the corresponding tone color effect parameter is determined in accordance with a distance (display interval) between the source object OS and the destination object OD, and the thus-determined control value is supplied to the tone generator/effect circuit 7, at step S43.

As set forth above, the instant embodiment is constructed to move, in response to operation of a control operating member, the displayed position, on the parameter control screen (see FIG. 3), of a source object OS on and along a rail object OD toward or away from a destination object OD indicative of a target of control. Thus, the user can enjoy controlling a tone color effect parameter while visually enjoying variation in positional relationship among these display objects.

Further, from the positional relationship among the display objects, the user can intuitively establish and cancel association (patching) between the control operating member and the tone color effect parameter and can readily grasp relationship between an operation amount of the control operating member and a control value of the tone color effect parameter. Namely, the user is allowed to perform patching and tone color effect parameter control while intuitively grasping an operational feeling of the control operating member, by operating the control operating member while viewing the individual display objects on the parameter control screen.

Further, by editing the parameter control screen in such a manner that one source object OS enters the effective areas KA of a plurality of destination objects OD simultaneously (see (f) of FIG. 4) or sequentially (see (g) of FIG. 4) in response to operation of the control operating member, the user can readily control a plurality of tone color effect parameters simultaneously or while switching among the tone color effect parameters.

Furthermore, the user is allowed to readily and freely set a degree of effectiveness of tone color effect parameter control responsive to operation of a control operating member, by changing as necessary the displayed orientation, line length (start and end points of the line), shape, etc. of the corresponding rail object R on the parameter control screen. Further, because the displayed position of the source object OS moves on and along the rail object R in response to operation of the control operating member, the user can enjoy controlling the tone color effect parameter while visually enjoying the control.

Figure 8A:
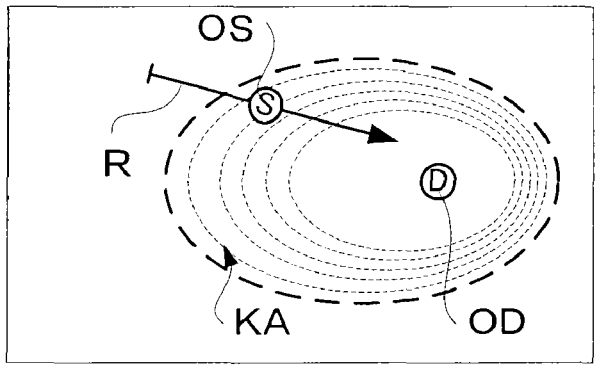
FIGS. 8A, 8B and 8C are conceptual diagrams explanatory of other examples of the tone color effect parameter control using the parameter control screen.

Note that the effective area KA of the destination object OD may be of any desired shape other than a perfect circle, such as an elliptical shape, polygonal shape or closed curve shape in the form of a free curve. The user may select a desired shape of the effective area KA from among a plurality of shapes. Further, an absolute distance (display interval) may be determined as the distance (display interval) between the center of the displayed destination object OD in the effective area KA and the displayed source object OS. Alternatively, a plurality of virtual equidistant curves may be provided in advance within the effective area KA as shown in FIG. 8A, so that the distance (display interval) can be determined approximately on the basis of one of the virtual equidistant curves to which the source object OS is located closest.

Figure 8B:
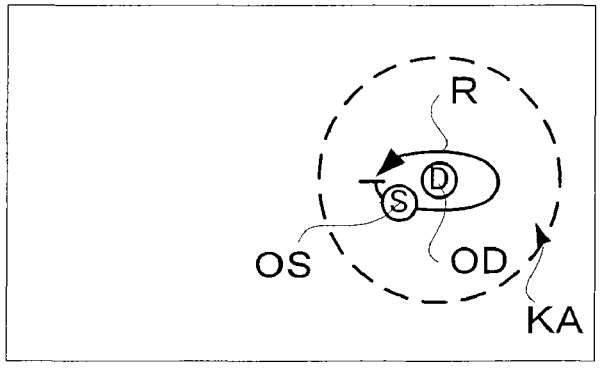
Figure 8C:
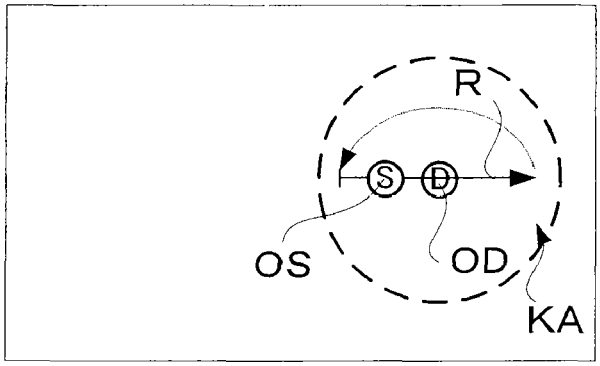

Furthermore, where the control operating member is an endlessly operable member, such as a rotary encoder, the rail object R may be in the form of an endless path. For example, the rail object R may be displayed in a closed shape having its start point and end point located at exactly the same position as shown in FIG. 8B; the rail object R may be in any closed shape as long as the source object OS loops on and along the rail object R. Alternatively, the rail object R may be displayed in a limited line of a non-closed shape so that, once the displayed source object OS reaches the end point of the rail object R, it is caused to jump back to the start point of the rail object R, as shown in FIG. 8C. In these cases, a control value at a time point immediately before returning to the rail start point (namely, control value at the rail end point) may be added to a control value determined on the basis of a distance (display interval) between the displayed source object OD and the displayed source object OS, instead of a control value being merely determined and output on the basis of the distance (display interval) between the displayed source object OD and the displayed source object OS; namely, the control value to be output at the rail start point is changed to the control value at the rail end point, rather than being fixed at "0", each time the source object OD returns to the rail start point. Thus, the control value increases or decreases while repeating the same variation every predetermined operation amount of the control operating member.

Note that the instant embodiment may be arranged to permit modification or change of the above-mentioned object data during the above-described parameter control process (see FIG. 7). For example, the positions of the start point and end point of the rail object R may be changed and the effective area KA of the destination object OD may be enlarged or contracted in size, using the mouse and two-dimensional pointing operating member of the touch panel. In this way, the user can readily establish or cancel patching and change a degree of effectiveness of control responsive to operation of a control operating member while at the same time performing music performance operation (i.e., operation of the keyboard and control operating member), and thus, a greatly enhanced convenience can be achieved.

Whereas the preferred embodiment has been described as establishing patching when a source object OS is located within an effective area KA, the present invention is not so limited, and patching may be established when part of the rail object R is located within the effective area KA. However, in this case too, no control amount is supplied to the tone generator/effect circuit 7 before the source object OS enters the effective area kA.

As a modification, different screens corresponding to different tone colors may be displayed on the parameter control screen, so that a desired range in any desired one of the tone-color-specific screens can be designated and objects included in the designated range are copied and pasted to another one of the screens. In such a case, the corresponding tone color parameter data are updated in response to the pasting of the objects, and, needless to say, once a source object OS is pasted into the effective area KA of any one destination object OD, association information is generated regarding the associated control operating member (source object OS) and tone color effect parameter (destination object OD).

Note that the two-dimensional pointing operating member (or object operating member) may be other than the mouse or touch panel, such as arrow keys or pad.

This application is based on, and claims priority to, JP PA 2008-157276 filed on 16 Jun. 2008 and JP PA 2008-157277 filed on 16 Jun. 2008. The disclosure of the priority applications, in its entirety, including the drawings, claims, and the specification thereof, is incorporated herein by reference.

What is claimed is:

1. An electronic music apparatus comprising:

a control operating member;

a display device that displays at least a first display object associated with said control operating member and a second display object associated with a tone color effect parameter;

a display control section that controls variation of a displayed position of said first display object in accordance with operation of said control operating member;

a determination section that determines a control value of the tone color effect parameter, associated with said second display object, in accordance with a distance between respective displayed positions of said first display object and said second display object; and a tone control section that performs tone control on the basis of the control value of the tone color effect parameter determined by said determination section.

2. The electronic music apparatus as claimed in claim 1, which further comprises an object operating member that directly designates said first display object or said second display object displayed on said display device and gives an instruction for changing the displayed position of the designated first or second display object, and said display control section, in response to the instruction, controls variation of the displayed position of said first display object also in accordance with operation of said object operating member.

3. An electronic music apparatus comprising:

a control operating member;

a display device that displays at least a first display object associated with said control operating member and a second display object associated with a tone color effect parameter;

a display control section that controls variation of a displayed position of said first display object in accordance with operation of said control operating member;

a determination section that determines a control value of the tone color effect parameter, associated with said second display object, in accordance with relationship between respective displayed positions of said first display object and said second display object; and a tone control section that performs tone control on the basis of the control value of the tone color effect parameter determined by said determination section, wherein an effective area, representing a range over which parameter control is made effective, is set in said second display object displayed on said display device, and wherein said display control section associates in advance the first and second display objects in such a manner that control, by said control operating member associated with said first display object, of the tone color effect parameter associated with said second display object is made effective on condition that said first display object is located within the effective area, said determination section determining a control value of the tone color effect parameter in accordance with relationship between respective displayed positions, within the effective area, of said first display object, whose displayed position is controlled in accordance with operation of said control operating member, and said second display object.

4. The electronic music apparatus as claimed in claim 3, wherein said display device displays a plurality of the second display objects each associated with a different tone color effect parameter, and wherein said display control section associates in advance the first and second display objects in such a manner that control, by said control operating member associated with said first display object, of the tone color effect parameters associated with said second display objects is made effective when said first display object is located within respective effective areas set in the plurality of the second display objects, said display control section simultaneously determining control values of the tone color effect parameters in accordance with relationship between respective displayed positions, within the effective areas, of said first display object, whose displayed position is controlled in accordance with operation of said control operating member, and the plurality of the second display objects.

5. The electronic music apparatus as claimed in claim 3, wherein said display device displays a plurality of the first display objects each associated with a different control operating member, and wherein said display control section associates in advance the first and second display objects in such a manner that said display control section selects any one of the plurality of the first display objects and control, by the control operating member associated with the selected first display object, of the tone color effect parameter associated with said second display object is made effective when the plurality of the first display objects are located within the effective areas set in one said second display object, said display control section determining a control value of the tone color effect parameter in accordance with relationship between respective displayed positions, within the effective areas, of the selected first display object, whose displayed position is controlled in accordance with operation of said control operating member, and said second display object.

6. A computer-implemented method for controlling a tone in response to operation of a control operating member, said method comprising:

a step of displaying at least a first display object associated with the control operating member and a second display object associated with a tone color effect parameter;

a step of controlling variation of a displayed position of said first display object in accordance with operation of said control operating member;

a step of determining a control value of the tone color effect parameter, associated with said second display object, in accordance with a distance between respective displayed positions of said first display object and said second display object; and a step of performing tone control on the basis of the control value of the tone color effect parameter determined by said step of determining.

7. A non-transitory computer-readable medium storing a program causing a computer to perform method for controlling a tone in response to operation of a control operating member, said method comprising:

a step of displaying at least a first display object associated with the control operating member and a second display object associated with a tone color effect parameter;

a step of controlling variation of a displayed position of said first display object in accordance with operation of said control operating member;

a step of determining a control value of the tone color effect parameter, associated with said second display object, in accordance with a distance between respective displayed positions of said first display object and said second display object; and a step of performing tone control on the basis of the control value of the tone color effect parameter determined by said step of determining.

8. The electronic music apparatus as claimed in claim 3, which further comprises an object operating member that directly designates said first display object or said second display object displayed on said display device and gives an instruction for changing the displayed position of the designated first or second display object, and said display control section, in response to the instruction, controls variation of the displayed position of said first display object also in accordance with operation of said object operating member.

9. A computer-implemented method for controlling a tone in response to operation of a control operating member, said method comprising:

a step of displaying at least a first display object associated with the control operating member and a second display object associated with a tone color effect parameter;

a step of controlling variation of a displayed position of said first display object in accordance with operation of said control operating member;

a step of determining a control value of the tone color effect parameter, associated with said second display object, in accordance with relationship between respective displayed positions of said first display object and said second display object; and a step of performing tone control on the basis of the control value of the tone color effect parameter determined by said step of determining, wherein an effective area, representing a range over which parameter control is made effective, is set in said second display object displayed on said step of displaying, and wherein said step of controlling associates in advance the first and second display objects in such a manner that control, by said control operating member associated with said first display object, of the tone color effect parameter associated with said second display object is made effective on condition that said first display object is located within the effective area, said step of determining determining a control value of the tone color effect parameter in accordance with relationship between respective displayed positions, within the effective area, of said first display object, whose displayed position is controlled in accordance with operation of said control operating member, and said second display object.

10. A non-transitory computer-readable medium storing a program causing a computer to perform method for controlling a tone in response to operation of a control operating member, said method comprising:

a step of displaying at least a first display object associated with the control operating member and a second display object associated with a tone color effect parameter;

a step of controlling variation of a displayed position of said first display object in accordance with operation of said control operating member;

a step of determining a control value of the tone color effect parameter, associated with said second display object, in accordance with relationship between respective displayed positions of said first display object and said second display object; and a step of performing tone control on the basis of the control value of the tone color effect parameter determined by said step of determining, wherein an effective area, representing a range over which parameter control is made effective, is set in said second display object displayed on said step of displaying, and wherein said step of controlling associates in advance the first and second display objects in such a manner that control, by said control operating member associated with said first display object, of the tone color effect parameter associated with said second display object is made effective on condition that said first display object is located within the effective area, said step of determining determining a control value of the tone color effect parameter in accordance with relationship between respective displayed positions, within the effective area, of said first display object, whose displayed position is controlled in accordance with operation of said control operating member, and said second display object.

* * * * *